US010184357B2

(12) United States Patent
Mane et al.

(10) Patent No.: US 10,184,357 B2
(45) Date of Patent: Jan. 22, 2019

(54) LIFT DEVICE FOR TURBINE CASING AND METHOD TO LIFT THE CASING

(71) Applicant: General Electric Company, Schenectady, NY (US)

(72) Inventors: Netaji Haribhau Mane, Bangalore (IN); Padmapriya Vijayakumar, Bangalore (IN); Jason Allen Seale, Greenville, SC (US)

(73) Assignee: General Electric Company, Schenectady, NY (US)

( * ) Notice: Subject to any disclaimer, the term of this patent is extended or adjusted under 35 U.S.C. 154(b) by 329 days.

(21) Appl. No.: 15/017,968

(22) Filed: Feb. 8, 2016

(65) Prior Publication Data

US 2017/0226898 A1 Aug. 10, 2017

(51) Int. Cl.
*F01D 25/24* (2006.01)
*F01D 25/28* (2006.01)

(52) U.S. Cl.
CPC ..... *F01D 25/285* (2013.01); *F01D 25/24* (2013.01); *F05D 2220/32* (2013.01); *F05D 2230/68* (2013.01); *F05D 2240/14* (2013.01)

(58) Field of Classification Search
None
See application file for complete search history.

(56) References Cited

U.S. PATENT DOCUMENTS

| | | | | |
|---|---|---|---|---|
| 5,106,264 | A | 4/1992 | Gros | |
| 6,352,404 | B1 | 3/2002 | Czachor et al. | |
| 8,127,417 | B1 | 3/2012 | Butler et al. | |
| 8,876,448 | B1 | 11/2014 | Hess et al. | |
| 2014/0193252 | A1 | 7/2014 | Seale et al. | |
| 2014/0356152 | A1* | 12/2014 | Hynous | F01D 25/24 415/201 |
| 2016/0222829 | A1 | 8/2016 | Hulfenhaus et al. | |

FOREIGN PATENT DOCUMENTS

EP 2 851 522 A1 3/2015

OTHER PUBLICATIONS

Extended European Search Report and Opinion issued in connection with corresponding EP Application No. 17154879.5 dated Jun. 12, 2017.

* cited by examiner

*Primary Examiner* — Igor Kershteyn
*Assistant Examiner* — Theodore Ribadeneyra
(74) *Attorney, Agent, or Firm* — Nixon & Vanderhye P.C.

(57) ABSTRACT

A partially assembled casing for a turbine including: an assembly of connected casing sections, wherein the assembly does not form a complete casing for the turbine; a gap in the assembly of connected casing sections, wherein the gap corresponds to an absent casing section which is not included in the assembly of connected casing sections, and a frame inserted in the gap and providing structural support to the assembly of connected casing sections.

19 Claims, 5 Drawing Sheets

LIFT DEVICE FOR TURBINE CASING AND METHOD TO LIFT THE CASING

BACKGROUND OF THE INVENTION

The invention relates to lifting and moving industrial gas turbines. The invention particularly relates to lifting and moving the casing for power generation sites lacking the capacity to lift or move the entire gas turbine.

Industrial gas turbines are typically large, heavy engines commonly found in power generation sites. The cranes, floor supports and other equipment needed to lift and move gas turbines may not be available in all power generation sites. Similarly, the roads leading to power generation sites may not have sufficient capacity to withstand the weight (mass) of trucks carrying an entire gas turbine.

Many power generation sites do not have a heavy lift crane with the capacity to lift a fully-assembled industrial gas turbine. Where there is insufficient lift capacity, the current practice is to remove the entire upper casing and rotor of a gas turbine to reduce the weight of the remaining turbine. The disassembly and subsequent reassembly process of the gas turbine is time consuming, such as four weeks or longer. The reassembly process also involves time consuming realignments of sections of the gas turbine casing as each section is fastened to other casing sections. There is a long felt need for methods and equipment that made possible lifting and moving of gas turbines at power generation sites that lack facilities to lift and move an entire industrial gas turbine.

BRIEF SUMMARY OF THE INVENTION

A method has been invented that enables lifting and moving of a partially assembled gas turbine casing, without requiring the realignment of the casings after the lift. The mass of the casing assembly is reduced by removing a section of the casing before the remaining partially assembled casing is lifted and moved. In place of the removed casing section, a novel frame is fastened to the casing for the gas turbine to provide support for missing sections of the casing. The frame is bolted to both horizontal and vertical joints of sections of the partially casing assembly. The frame provides substantially the same structural support to the casing as would have been provided by the removed casing section. The partially assembled gas turbine casing with the frame is lifted and transported with minimal risk that the casing sections will deform and require alignment after the lift and transport.

In one embodiment, the invention is a partially assembled casing for a turbine including: an assembly of connected casing sections, wherein the assembly does not form a complete casing for the turbine; a gap in the assembly of connected casing sections, wherein the gap corresponds to an absent casing section which is not included in the assembly of connected casing sections, and a frame inserted in the gap and providing structural support to the assembly of connected casing sections.

The invention may also be embodied as A partially assembled casing for a gas turbine including: an assembly of connected casing sections, wherein the assembly does not form a complete casing for the turbine and the casing sections include upper and lower casing sections for a turbine, upper and lower casing sections for a compressor and a lower casing section for an inlet; a gap in the assembly of connected casing sections, wherein the gap corresponds to an absent upper casing section for the inlet, and a frame inserted in the gap and providing structural support to the assembly of connected casing sections, wherein the frame includes a first bracket fastened to an exposed joint surface of the upper casing section for the compressor and a second bracket fastened to an exposed joint surface of the lower casing section for the inlet.

In another embodiment the invention is a method to move a turbine casing including: assembling casing sections to form a partial assembly of casing sections, wherein a gap remains in the assembly of casing sections at a location corresponding to an absent casing section; attaching a frame to the assembly of casing sections, wherein the frame is in the gap and the frame is attached to a vertical joint surface and a horizontal joint surface on the assembly; attaching a lifting device to the assembly of casing sections with the attached frame, and lifting the assembly of casing sections with the attached frame, with the lifting device.

DETAILED DESCRIPTION OF THE INVENTION

Industrial gas turbines are large and heavy engines. An industrial gas turbine may have a mass of, for example, in a range of 100 to 300 tons (90,000 kg to 272,000 kg). The dimensions of an industrial gas turbine may be, for example, a length of 30 to 50 feet (9 to 15 meters), and height and width of 12 to 20 feet (3.5 to 6 m).

Occasions arise when it is necessary to lift and move an industrial gas turbine. If rebuilding or other substantial maintenance is needed, the gas turbine may be lifted out of its operating support frame to another support frame where the gas turbine may be rebuilt or which may be used to transport the gas turbine to a maintenance facility.

At power generation sites not suited for heavy lift cranes or lacking roads or other infrastructure sufficient to carry a fully assembled gas turbine, it has been common practice to disassemble a gas turbine while the turbine seated in its operating support frame. The sequence of disassembly includes detaching and separately removing each of the sections of the upper casing; removing the rotor from the assembled lower casing, and separately detaching and removing each section of the lower casing. This removal process is time consuming and prone to bending and thereby damaging the casing sections. Lifting a fully assembled gas turbine by cables connected to the lifting posts tends to not unduly deform the casing or create a need to realign the casing sections.

Lifting a massive gas turbine places large loads on the casing at the lifting pins and removes the supports to the casing provided by the support frame. These shifts in the loads applied to the casing could cause the casing to deform. Because the casing is fully assembled and is designed to be lifted while fully assembled, the load shifts due to lifting tend to no unduly deform the gas turbine or require substantial realignments of the casing. Also, the sections of the casing are bolted together and thus prevented from becoming misaligned with each other.

Lifting a partially assembled gas turbine and, particularly, where one or more sections of the casing are removed before the lift creates a larger potential risk that the gas turbine will deform during the lift and the casing will require alignment after the lift. The casing may deform due to the shift in the forces applied to the casing during the lift. The deformation increases the risk of misalignment between the casing and the casing section that is attached after the lift.

Figure 1:
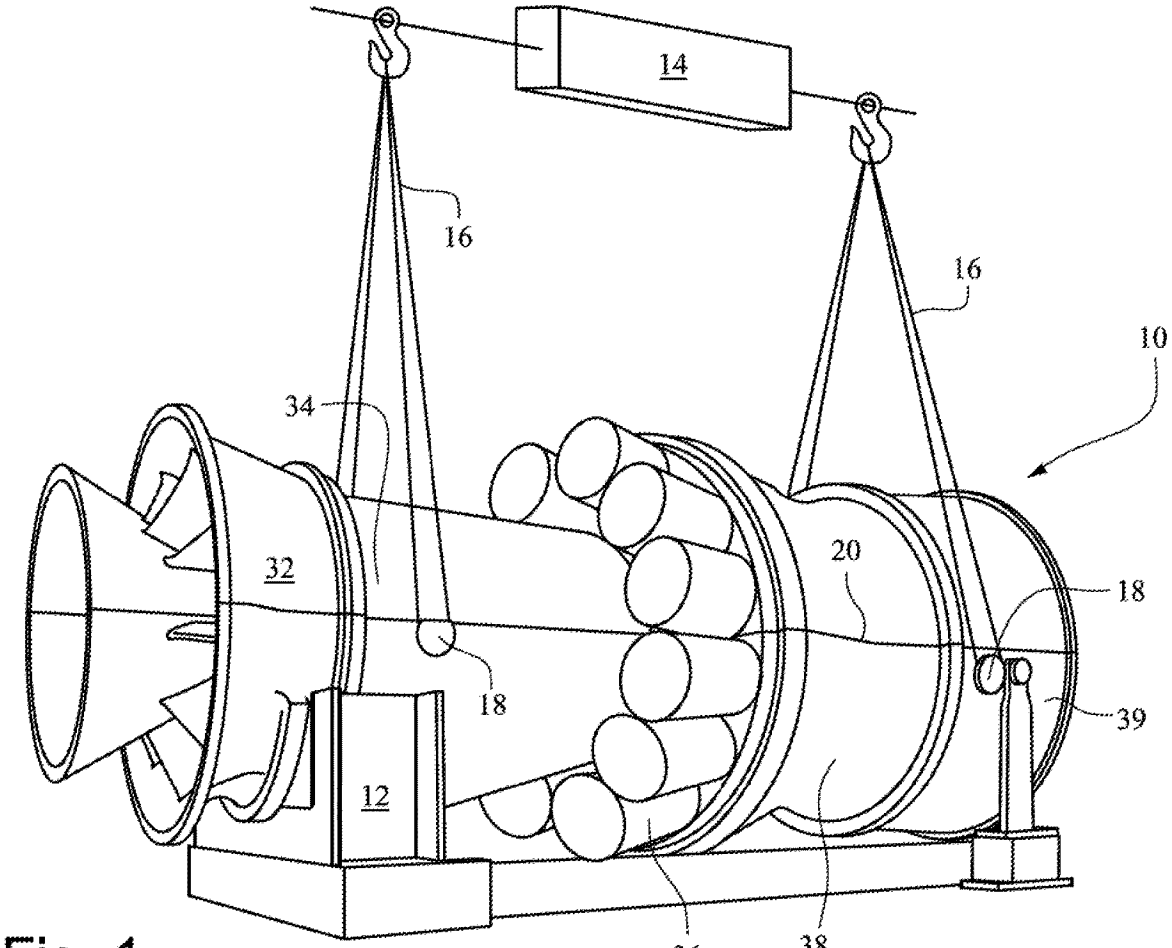
FIG. 1 is a perspective side view of a fully assembled gas turbine.

FIG. 1 illustrates an industrial gas turbine 10 seated on a shipping support frame 12 and attached to a crane 14 by lifting cables 16. The lifting cables attach to lifting posts 18 on opposite sides of the casing. The lifting posts 18 are generally at a mid-height of the casing and positioned near a horizontal joint 20 between the upper and lower sections of the casing of the gas turbine.

The inventors recognized a need for a better method to move a partially disassembled industrial gas turbine. The inventors conceived of a method and a frame which reduce the time and associated cost in lifting and moving a gas turbine casing and reduces the risk of deforming the casing sections during a lift of move. In the method, sections of the upper casing are temporarily removed to allow removal of the rotor, and most of the sections of the upper casing are attached to the lower casing after the rotor is removed. For those portion(s) of the upper casing not attached, a frame is attached to the lower casing and the remaining upper casing. The frame prevents deformation of the casing while the partially assembled gas turbine casing is lifted and moved.

By partially reassembling the casing after removal of the rotor, the casing becomes more structurally rigid due to the completed joints between the sections of the casing. The frame provides the casing support functions that would have been performed by the removed casing section. Because the casing sections supported by being joined to other casing sections or to the frame, all of the casing sections are less subject to deformation while be lifted and removed.

The mass, e.g., weight, of the partially assembled casings is substantially less than the mass of the gas turbine with rotor. Also the removal of one or more casing sections reduces the mass of the casings. The lower mass allows the partially assembled casings to be removed from smaller cranes and for the casings to be moved with transports, such as trucks, that are able to travel over roads that cannot support the entire weight of a complete gas turbine.

Figure 2:
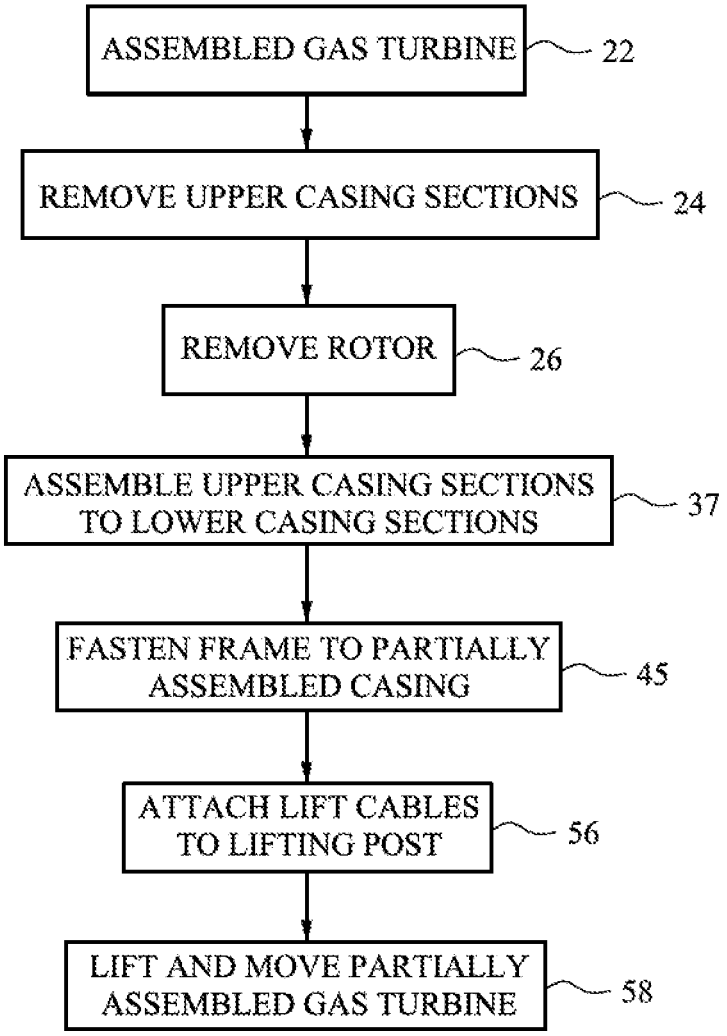
FIG. 2 is a flow chart of a method for partially disassembling and moving a gas turbine.

FIG. 2 is a flow chart of an exemplary method to partially disassemble and move an industrial gas turbine. The gas turbine is in a fully assembled condition with the rotor in place in step 22. The fully assembled gas turbine may be on a support frame for transport or maintenance, such as shown in FIG. 1. Alternatively, the gas turbine may be on an operational support frame on site at a power generation facility. When on an operational support frame, the inlet end of the gas turbine may be coupled to an air outlet of an air duct assembly, and the turbine exhaust end of the gas turbine may be connected to the inlet of an exhaust diffuser.

While the gas turbine is on the operational support frame and positioned between the air inlet duct and exhaust diffuser duct, the available working space around gas turbine may be small and insufficient to allow rebuilding and extensive maintenance of the gas turbine. To rebuild or conduct extensive maintenance, the gas turbine often must be moved to a maintenance facility or a site at the power generation facility that has sufficient working space around the gas turbine for rebuilding and maintenance.

In step 24, the upper casing of the gas turbine is removed to expose the rotor. In step 26, a crane above the gas turbine lifts the rotor from the lower casing of the gas turbine. The rotor may be moved separately from the casing to a site where it may be repaired, maintained or otherwise rebuilt.

Figure 3:
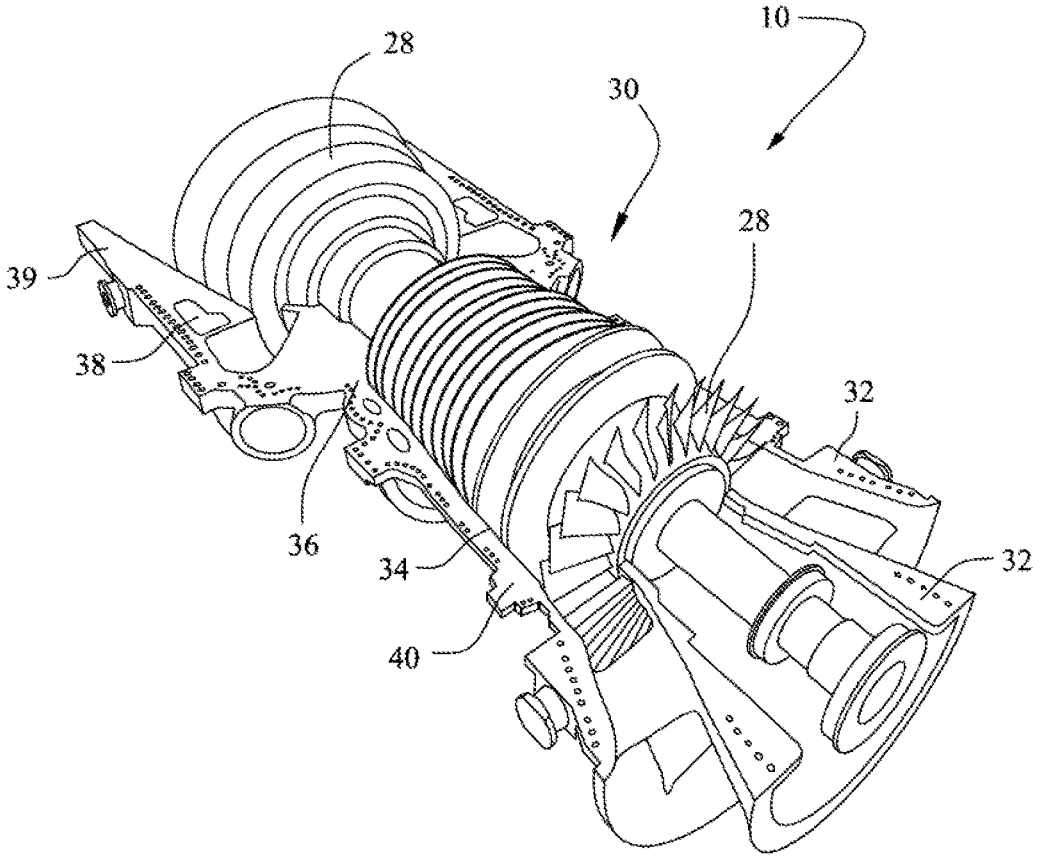
FIG. 3 is a top down view of a rotor for a gas turbine and a lower casing, wherein the upper casing has been removed.

FIG. 3 shows a gas turbine 10 in which the upper casing has been removed and the rotor 28 is exposed. The rotor, which includes a shaft, rows of blades for an axial compressor and rows of buckets (blades) of an axial turbine. The rotor may be lifted upward to be removed from the lower casing 30 of the gas turbine.

The lower casing 30 and the upper casing are each an assembly of casing sections. The casing sections may each extend halfway around the rotor, such that the casing sections are either upper or lower sections. An upper and lower casing section when assembled extends entirely around the rotor. Alternatively, the casing sections may be quarter sections that each extend around one quarter of the perimeter of the rotor.

The casing assembly is segmented into casing sections. For example, the casing assembly includes lower and upper sections for an inlet casing 32 (see FIGS. 1 and 2), a compressor casing 34, a combustor casing 36, a turbine casing 38, and a turbine exhaust casing 39. The upper and lower compressor sections 34 house the portion of the rotor including axial compressor blades and of stationary vanes between the rows of compressor blades. The upper and lower casing sections for the compressor and combustor may each be each a single piece component. The upper and lower combustor casing sections include openings and supports for combustion cans arranged in an annular array around the perimeter of the casing. The upper and lower turbine casing sections house the turbine section of the rotor which includes rows of stationary nozzles between the rows of the turbine buckets.

FIG. 3 shows that the lower casing sections assembled together and exposing horizontal surfaces 40 on opposite sides of the rotor and extending the length of the gas turbine. The joint surfaces 40 include bolt holes to receive the bolts or other fasteners for the casings.

In step 37 of FIG. 2 and after the rotor is removed, the casings sections are assembled together and fastened by bolts or other fasteners. Each casing section has joint surfaces, typically vertical or horizontal planar surfaces. The joint surfaces are configured to abut and align with joint surfaces of adjacent casing sections horizontal or vertical joint lines.

Figure 4:
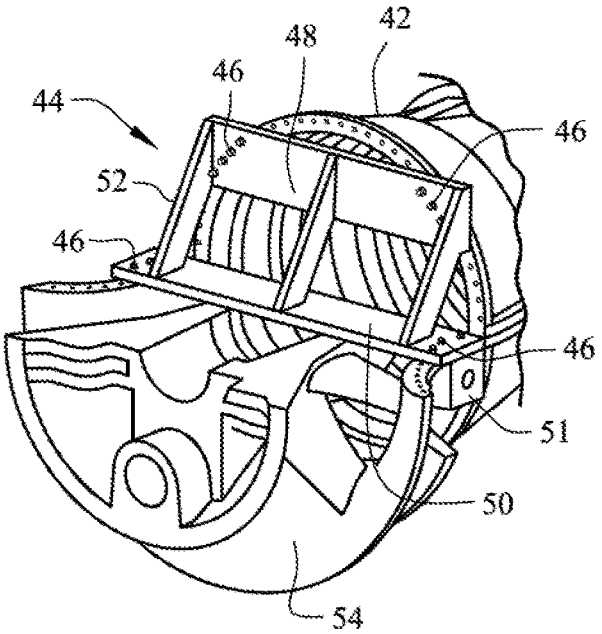
FIG. 4 is a perspective view of the front and side of a partially assembled casing of the gas turbine.

FIG. 4 shows a front portion of a partially reassembled gas turbine casing 42. The rotor has been removed from the casing 42 while the lower half casing sections remained assembled. The upper casing sections have been reattached to the casing by bolting each upper casing section to its corresponding lower casing sections and to adjacent upper casing sections.

The partially assembled casing 42 includes all sections of the lower half of the casing and all of the sections of the upper half except for the inlet casing. In place of the upper section of the inlet casing, a frame 44 is fastened to the partially assembled casing in step 45. The frame provides the structural support to the casing that would have otherwise been provided by the upper inlet casing.

By partially reassembling the casing 42 and fastening the frame 44 to the casing, the casing sections are all either bolted to each other or to the frame. The partial casing assembly 42 is kept in alignment because the casing sections and frame are bolted together. The bolts joining adjacent sections of the casing maintain the alignment of the bolt holes in the adjacent sections. Similarly, the bolts extending through the frame and the casing sections adjacent to the frame maintain the alignment between the bolt holes in those casings and the bolt holes in the frame.

The frame 44 has sufficient structural rigidity to prevent deformation of the casing sections to which the frame is attached. The bolt holes 46 in the frame are aligned with corresponding bolt holes in an adjacent section of the casing. By bolting the frame to the casing, the frame ensures that the casing in general and specifically the casing sections to which the frame is bolted do not deform with the partially assembled casing 42 is lifted and moved.

Figure 5:
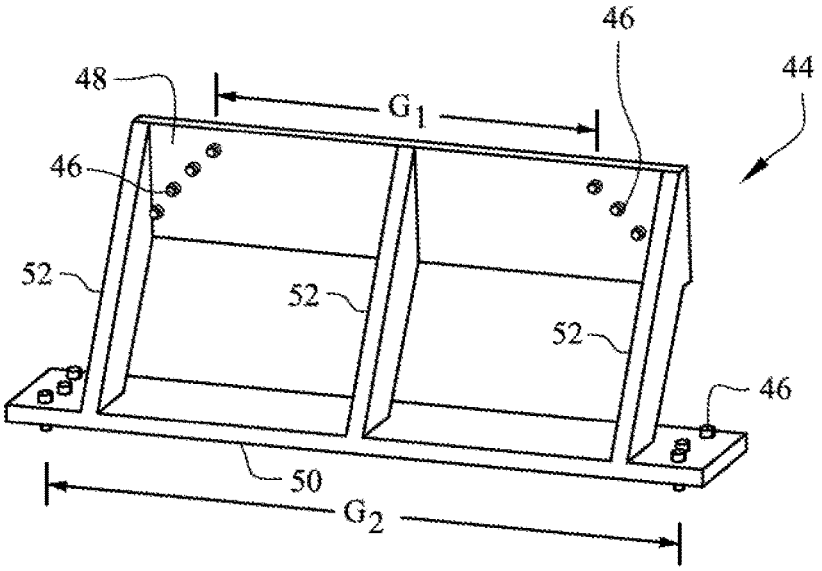
FIG. 5 is a perspective view of the front and side of a frame for the casing and configured to be in the position of an upper casing section of the inlet to the gas turbine.

As shown in FIG. 5, the frame 44 includes a first bracket 48 having a vertically oriented surface and bolt holes 46 corresponding to the bolt holes in a casing section to which the first bracket is configured to be attached. The first bracket may be a metal plate having a thickness of several inches or more, e.g., three inches or 25 mm. The first bracket has two sets of bolt holes 46. Each set of bolt holes may be two, three, four or more bolt holes. Each set of bolt holes may be configured to align with a set of consecutive bolt holes on a joint surface of one of the casing sections. The two sets of bolt holes on the first bracket align with sets of bolt holes on a vertical joint surface of the upper compressor casing section. The two sets of bolt holes are on opposite sides of the upper compressor casing.

The frame also includes a second bracket 50 having a horizontal oriented surface with holes corresponding to the bolt holes in a casing section to which the second bracket is configured to attach. The second bracket may be a metal plate having the same thickness as the first bracket. The horizontally oriented surface may be a horizontal planar surface.

The second bracket may be longer than the first bracket. The second bracket spans the width of the casing along a center plane of the casing, which is the widest portion of the casing. The first bracket spans an upper (or lower) region of the casing that is offset from the center plane. The gap G1 between the two sets of bolt holes on the upper casing section aligned with the sets of bolt holes on the first bracket determines the length of the first bracket. Similarly, the gap G2 between the two sets of bolt holes on opposite sides of the lower inlet casing section determines the length of the second bracket.

The second bracket 50 may be positioned on the casing assembly to be adjacent a lifting attachment device 51. The lifting attachment device may be lifting posts, apertures to receive a hook of a crane or other device that provides a grip to receive the lifting cables of a crane. The lifting attachment device may be on opposite sides of the casing, such as on opposite sides of the lower inlet casing 54. By bolting the second bracket adjacent to the lifting attachment devices, the lifting forces applied to the casing are more directly transferred to the frame than if the second or first bracket were not proximate to the lifting attachment devices.

In step 56 (FIG. 2), lifting cables are attached to the lifting attachment devices on opposite sides of the partially assembled casing. In step 58, a crane attached to the lifting cables lifts and moves the partially assembled casing with the attached frame. The lifting and movement of the partially assembled casing is accomplished without unduly deforming the casing or creating a need for a time-consuming and expensive realignment of the casing sections.

The first and second brackets are joined by ribs 52 extending between the brackets. The ribs may be metal plates welded at each end to one of the brackets. The ends of each rib may be configured to contact one of the brackets along the entire length of the end. The welds between the rib end and the bracket may extend the length of the rib end and be on opposite sides of the rib ends. There may be three ribs wherein two of the ribs are near the bolt holes in the brackets and the third rib is at a center region of the frame. The thickness of the ribs may be substantially, e.g., within fifteen percent, of the thickness of either of the brackets.

The ribs may be each in a plane parallel to the axis of the casing. By orienting the ribs in a plane parallel to the casing axis, the forces applied in an axial direction against the upper or lower brackets are transmitted along the centerline of the ribs with minimal torsion being applied to the ribs.

The upper ends of the outer two ribs may be welded to ends of the first bracket. The lower ends of the outer two ribs may be welded to an upper planar surface of the second bracket and be welded inward of the sets of the bolt holes on the second bracket.

The mass of the frame is substantially, e.g., less than one third, of the mass of the section of the casing being replaced by the frame. For example, the inlet casing sections typically have a large mass relative to the other casing sections. Removing the upper inlet casing section reduces substantially, e.g., by over twenty percent, the mass of the casing of the gas turbine. The frame may be less than one third the mass of the upper inlet casing section. By replacing the upper inlet casing section with the frame the mass of the remaining gas turbine casing assembly may be reduced by ten to fifteen percent. The reduction in mass may be sufficient to allow the partially assembled gas turbine casing to be lifted by a crane from a particular power generation site. Similarly, the reduction in mass may be sufficient to allow the partially assembled gas turbine casing to be transported over the roads leading from the power generation site.

Figure 6:
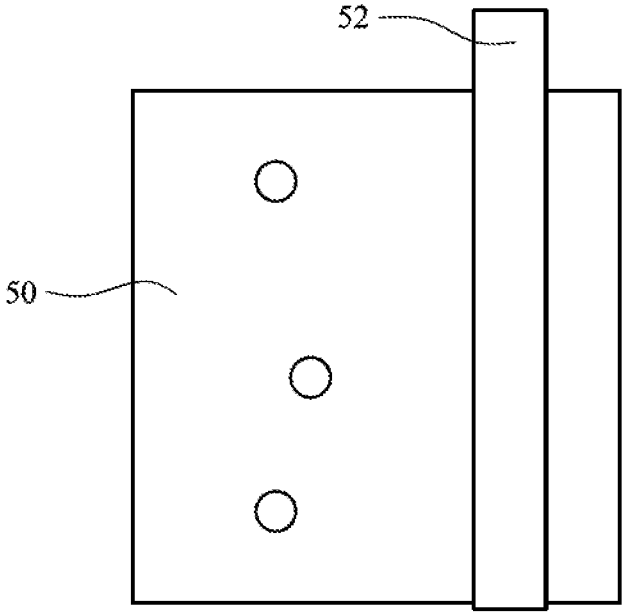
FIG. 6 is a top down view of a portion of a horizontal plate of the frame.
Figure 7:
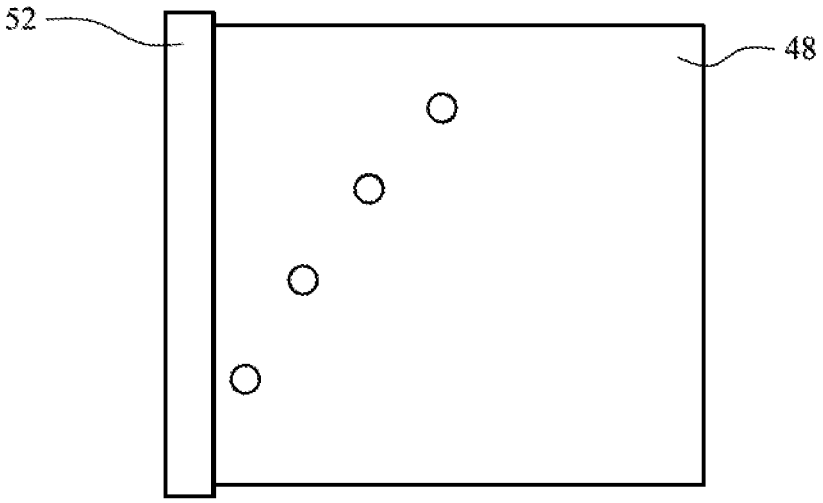
FIG. 7 is a front view of a portion of a vertical plate of the frame.

FIGS. 6 and 7 show plan views of the first and second brackets. These views show the pattern of the bolt holes in brackets 48, 50. The number and pattern of bolt holes are machined, e.g., drilled, and with sufficient precision to accurately alight with the bolt holes on the casing sections to which the brackets attach. Each group of bolt holes may be arranged in an arc as shown in FIGS. 6 and 7, or in a straight or curvilinear line. The arrangement of bolts holes will depend on the shape of the surface of the casing to which the bracket is to be fastened.

The bolt holes in the brackets are selected and positioned such that when bolts are inserted through the bolt holes and into the section casings, the bolts are sufficiently supported by the brackets to ensure that the section casing maintain proper alignment. Proper alignment is needed so that the missing casing section can be attached to the partial assembly of casing sections, preferably without extensive realignment of the missing casing section with the assembly of casing sections.

The ribs 52 may be attached to the first and second bracket proximate to, e.g., within five inches of, one of the bolt holes. By minimizing the distance between the rib and the nearest bolt hole to the rib, the moment forces are reduced that are applied to the bracket by the bolts and the rib.

The number of support ribs, thickness of the brackets and ribs, and number and location of the bolt holes are dependent on the mass and size of the gas turbine. To design the frame, including selecting the number of ribs, thicknesses of the brackets and ribs and location and number or bolt holes, a finite element analysis (FEA) may be performed to model the partially assembled casing and frame. The FEA model may be used to determine whether the partially assembled casing with the frame may be lifted and moved without unduly deforming the casing or creating a need for an extensive realignment of the casing sections.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A partially assembled casing for a turbine comprising:

an assembly of connected casing sections, wherein the assembly does not form a complete casing for the turbine;

a gap in the assembly of connected casing sections, wherein the gap corresponds to an absent casing section which is not included in the assembly of connected casing sections, a frame inserted in the gap and providing structural support to the assembly of connected casing sections, and the frame includes a vertical bracket and a horizontal bracket in a fixed relationship with the vertical bracket, wherein the vertical bracket is configured to attach to and support a vertical face of a first casing section of the assembly of connected casing sections, and wherein the horizontal bracket is configured to attach to and support a horizontal face of a second casing section of the assembly of connected casing sections, and the horizontal bracket spans an entirety of the width of the second casing section from one side of the second casing section to an opposite side.

2. The partially assembled casing as in claim 1 wherein the vertical bracket includes a substantially vertical planar surface bolted to a substantially vertical joint surface of the first connected casing section and the horizontal bracket includes a substantially horizontal vertical planar surface bolted to a substantially horizontal joint surface of the second connected casing section.

3. The partially assembled casing as in claim 1 wherein the vertical bracket includes a vertical planar surface abutting a vertical joint surface of the first connected casing section, and the horizontal bracket includes a horizontal planar surface abutting a horizontal joint surface of the second connected casing section.

4. The partially assembled casing as in claim 1 wherein the frame includes ribs attached to and extending between the vertical bracket and the horizontal bracket, wherein the ribs are aligned with planes parallel to an axis of the assembly of connected casing sections.

5. The partially assembled casing as in claim 3 wherein the horizontal and vertical brackets are metal plates each having a thickness of at least three inches.

6. The partially assembled casing as in claim 3 wherein the horizontal and vertical brackets each have sets of bolt holes, and each set of bolt holes is aligned with bolt holes on the vertical or horizontal joint surface.

7. The partially assembled casing as in claim 6 wherein each set of bolt holes in the first bracket has the bolt holes arranged in an arc and each set of bolt holes in the second bracket has the bolt holes arranged in a line or an arc.

8. The partially assembled casing as in claim 6 wherein the bolt holes in at least one of the horizontal and vertical brackets are proximate to a lifting attachment device on the assembly of connected casing sections.

9. The partially assembled casing as in claim 1 wherein the partially assembled casing is hollow and devoid of a rotor.

10. The partially assembled casing as in claim 1 wherein the turbine is a gas turbine and the assembly of connected casing sections includes upper and lower casing sections for a turbine, upper and lower casing sections for a compressor and a lower casing section for an inlet, wherein the absent section corresponds to an upper casing section for the inlet.

11. A partially assembled casing for a gas turbine comprising:

an assembly of connected casing sections, wherein the assembly does not form a complete casing for the turbine and the casing sections include upper and lower casing sections for a turbine, upper and lower casing sections for a compressor and a lower casing section for an inlet;

a gap in the assembly of connected casing sections, wherein the gap corresponds to an absent upper casing section for the inlet, and a frame inserted in the gap and providing structural support to the assembly of connected casing sections, wherein the frame includes a first bracket fastened to an exposed joint surface of the upper casing section for the compressor and a second bracket fastened to an exposed joint surface of the lower casing section for the inlet;

wherein the second bracket spans an entirely of the width of the lower casing section from one side of the lower casing section to an opposite side.

12. The partially assembled casing of claim 11 wherein the first bracket includes a vertical planar surface bolted to the exposed joint surface of the upper casing section for the compressor and a horizontal planar surface bolted to the exposed joint surface of the lower casing section for the inlet.

13. The partially assembled casing as in claim 11 wherein the frame includes ribs attached to and extending between the first and second brackets, wherein the ribs are aligned with planes parallel to an axis of the assembly of connected casing sections.

14. The partially assembled casing as in claim 11 wherein the first and second brackets are metal plates each having a thickness of at least three inches.

15. The partially assembled casing as in claim 11 wherein the first and second brackets each have sets of bolt holes, and each set of bolt holes is aligned with bolt holes on the substantially vertical or horizontal joint surfaces.

16. A method to move a turbine casing comprising:

assembling casing sections to form a partial assembly of casing sections, wherein a gap remains in the assembly of casing sections at a location corresponding to an absent casing section;

attaching a frame to the assembly of casing sections, wherein the frame is in the gap and the frame is attached to a vertical joint surface and a horizontal joint surface on the assembly, wherein attaching the frame includes fixing a vertical bracket of the frame to a vertically oriented end of a first casing section of the assembly of casing sections, and fixing a horizontal bracket of the frame to a second casing section of the assembly of casing sections such that the horizontal bracket spans an entirety of the width of the second casing section from one side of the second casing section to an opposite side;

attaching a lifting device to the assembly of casing sections with the attached frame, and lifting the assembly of casing sections with the attached frame, with the lifting device.

17. The method of claim 16 wherein the absent casing section is an upper inlet casing section.

18. The method of claim 16 further comprising removing a rotor of the turbine before attaching the frame to the assembly of casing sections.

19. The method of claim 16 wherein the attachment of the frame includes bolting the frame to the casing sections.

* * * * *